United States Patent [19]

Lutz

[11] 4,373,309

[45] Feb. 15, 1983

[54] SUPPORTING BOLT

[75] Inventor: Gerhard Lutz, Reutlingen, Fed. Rep. of Germany

[73] Assignee: Gelu Reutlinger Steinwerk Gerhard Lutz GmbH, Reutlingen, Fed. Rep. of Germany

[21] Appl. No.: 941,407

[22] Filed: Sep. 11, 1978

[51] Int. Cl.[3] ..... E04F 11/00; F16B 37/00

[52] U.S. Cl. ..... 52/182; 403/168; 411/389; 411/427

[58] Field of Search ..... 411/389, 378, 427; 52/187, 182; 403/168, 167

[56] References Cited

U.S. PATENT DOCUMENTS

| | | | |
|---|---|---|---|
| 1,062,015 | 5/1913 | Lane | 411/427 X |
| 2,061,751 | 11/1936 | Bosco | 411/389 |
| 3,114,941 | 12/1963 | Blum | 52/182 X |
| 3,713,260 | 1/1973 | Brauckmann | 52/187 |
| 3,916,591 | 11/1975 | Agterhof | 52/187 |

FOREIGN PATENT DOCUMENTS

| | | | |
|---|---|---|---|
| 7238093 | 1/1973 | Fed. Rep. of Germany . | |
| 2210415 | 9/1973 | Fed. Rep. of Germany . | |
| 2214831 | 10/1973 | Fed. Rep. of Germany . | |
| 7538432 | 5/1976 | Fed. Rep. of Germany . | |
| 7606438 | 7/1976 | Fed. Rep. of Germany . | |
| 7624504 | 11/1976 | Fed. Rep. of Germany . | |
| 384183 | 1/1965 | Switzerland | 411/389 |
| 922416 | 4/1963 | United Kingdom | 411/427 |
| 1009695 | 11/1965 | United Kingdom | 411/389 |

*Primary Examiner*—Ramon S. Britts

*Attorney, Agent, or Firm*—Browdy and Neimark

[57] ABSTRACT

A supporting bolt structure for connecting the ends of steps of a fabricated stairway including an elongated middle part having both internal and external threads at the ends thereof, a pair of internally threaded retainers mating with the external threads on the middle part and a pair of externally threaded headed portions mating with the internal threads of the middle part.

9 Claims, 2 Drawing Figures

SUPPORTING BOLT

FIELD OF THE INVENTION

The invention relates to a supporting bolt for connecting the ends of the steps of a prefabricated staircase to form a connection which is resistant to tensile and compressive forces. The bolt includes two end pieces, each end piece having a head and a retainer, the distance between the head and the retainer being adjustable for tightening a step against the head. The bolt includes a middle piece threadedly connected to the end pieces.

BACKGROUND OF THE INVENTION

In a supporting bolt of this type, one end piece consists of a sleeve with a through internal thread, whereby a head, provided with an extension with an external thread, is screwed into one side of the sleeve, while the sleeve has a collar on the opposite side, against which collar a washer surrounding the sleeve fits. The free end of a step is clamped between the head and the washer. The other end piece consists of a bolt, the bolt being provided at both ends with an external thread, whereby a head is screwed onto one external thread while the other external thread is screwed into the portion of the middle piece which is provided with an internal thread. The middle piece has an external thread at its opposite end, the thread being screwed into the internal thread of the sleeve of the other end piece. Two washers, between which the free end of a second step can be clamped, are provided around the end piece with the bolt with the external threads. This known supporting bolt has the disadvantage that it consists of eight differently shaped parts, so that its manufacture is very expensive.

According to German Utility Model 7,606,438, it is known to design the above-mentioned supporting bolt in such manner that it can be assembled from a few, simply manufactured parts. This is achieved by virtue of the fact that each retainer is in the form of a bushing with an internal thread, into which the external thread of the corresponding end piece and the middle piece can be screwed. However, this stair connection has the disadvantage that the middle piece and the end piece can be screwed into the bushing only until the ends which have been screwed in, touch. Hence, only steps of limited thickness can be gripped between the bushing and the end piece.

Austrian Pat. Nos. 230,607 and 295,112 disclose step connections wherein the supporting bolt is held at at least one of its ends by a screw anchor firmly imbedded in the steps or a threaded bushing, likewise imbedded in the concrete. This admittedly provides a simple overall design, but with the critical disadvantage that imbedding makes it impossible to completely disassemble the step connection. For example, if the firmly imbedded screw anchor is broken by excessive internal stresses which cannot be overcome in a staircase or for example if the screw anchor shifts during the casting process or the subsequent setting process, a supporting bolt connection of this type will not be usable. There is only limited possibility of repair, since it is very difficult to replace the defective part which is firmly imbedded in the concrete.

SUMMARY OF THE INVENTION

The object of the present invention is to provide a supporting bolt of the type described hereinabove which is easily disassembled, aside from being of simple design and easy to manufacture, and can be adjusted to fit step thicknesses of greater variation than those of the above-disclosed known art.

The foregoing object, as well as others which are to become clear from the text below, is achieved according to the invention by virtue of the fact that the middle piece is designed in the form of a one-piece long-shank middle bolt 5 having symmetrical ends, onto each of which ends a retainer can be screwed and into which a respective head can be screwed.

The fact that the retainer and head are provided with different thread sizes, one with an internal thread and the other with an external thread, a telescoping screw connection between the middle bolt and retainer, on the one hand, and between the middle bolt and head, on the other hand, is possible in contrast to a step connection according to the above-identified utility model 7,606,438, whereby not only can larger variation of step thicknesses be accommodated, but the difference in height between two steps can easily be changed, as well. Furthermore, considerable differences in stress between individual steps can easily be avoided by making fine adjustments. In this fashion, either of the two ends of the middle bolt can readily be adjusted independently of the other end, depending on which end is more easily accessible. The ease with which an individual supporting bolt connection can be exchanged or disassembled not only makes it easy to replace a defective connecting element, but also to readily disassemble and reassemble elsewhere a prefabricated staircase according to the invention, so that it is especially suitable as a temporary set of stairs. The symmetrical design of the middle bolt permits simple manufacture of a supporting bolt on a mass production basis and also facilitates assembly of a staircase designed according to the invention without the danger of confusing the ends of the middle bolt during assembly.

An advantageous embodiment of the invention provides that the head is designed as an end bolt with an elongated threaded section. The middle bolt can also be provided with a through internal bore. Advantageously, the internal bore is provided for its entire length with an internal thread. To fasten a bannister, the outer end of the head can be provided with an internal thread. A preferred embodiment is characterized by the fact that a support plate, serving as a support for a step against a vertical wall, can be gripped between the head and a corresponding holding element of an end piece. An especially simple design is produced if the holding element is designed as a bushing with a through internal thread. For reasons related to strength, as well as for esthetic reasons, the bushing can be in the form of a truncated cone, whose larger end is opposite the head of the corresponding end piece. The profile of the truncated cone can be curved in a concave manner, at least toward the larger end.

BRIEF DESCRIPTION OF THE DRAWING

The invention is described hereinbelow in greater detail with reference to the accompanying drawings.

DETAILED DESCRIPTION OF THE PREFERRED EMBODIMENT

Figure 1:
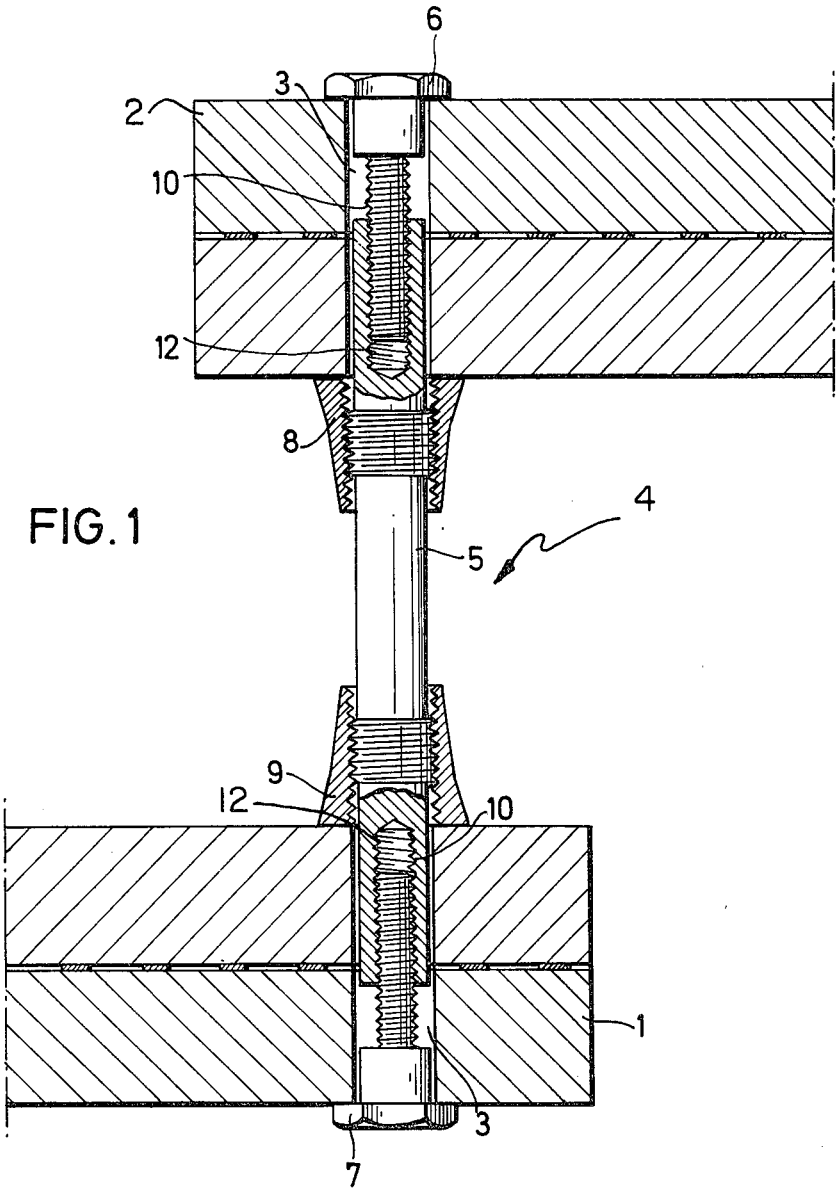
FIG. 1 shows a supporting bolt according to the invention with two steps in cross section.

According to FIG. 1, a supporting bolt 4 connects the free end of a step 1 with the free end of a step 2, appropriate holes 3 being provided in the steps 1, 2. The supporting bolt 4 consists of a first end piece with a first end bolt 6 and a first retainer 8 as well as a second end piece with a second end bolt 7 and a second retainer 9, together with middle bolt 5, threadedly connected to the end pieces. The middle bolt 5 has symmetrical ends, onto which ends of the retainers 8 and 9, preferably in the form of bushings with internal threads, are screwed. Internal bores 12 with internal threads are provided in the bolt ends in the axial direction, into which internal threads end the bolts 6 and 7 are screwed in such manner that the two steps 1 and 2 of a prefabricated staircase to be connected can be gripped firmly but releasably. Washers can be placed between the head parts of the end bolts 6 and 7 and the steps 2 and 1 to facilitate adjustability; these washers can also be replaced by an appropriate flanged part on the corresponding end bolt 6 or 7. The head part can be provided with means for accepting a bannister screwed into it. Each of the end bolts 6 and 7 has an elongated threaded section 10 which fits more or less deeply into the corresponding internal threaded bore 12 of the middle bolt 5, corresponding to the thickess of one 1, 2, when the supporting bolt arrangement is assembled. According to FIG. 1, two separate internal threaded bores 12 are provided in the ends of the middle bolt 5. However, the middle bolt 5 can also be designed with a through internal bore with internal threads. The outer surfaces of the retainer bushings 8 and 9 are in the form of a truncated cone whose profile is curved concavely. The larger ends of the bushings 8 and 9 abut the underside and the upper side of the steps 2 and 1, while the head parts of the end bolts 6 and 7 abut the upper side and the underside of the steps 2 and 1 by means of washers 10. The entire structure according to FIG. 1 is designed so that supporting bolt 5 is disposed symmetrically with respect to a horizontal line through the center.

Figure 2:
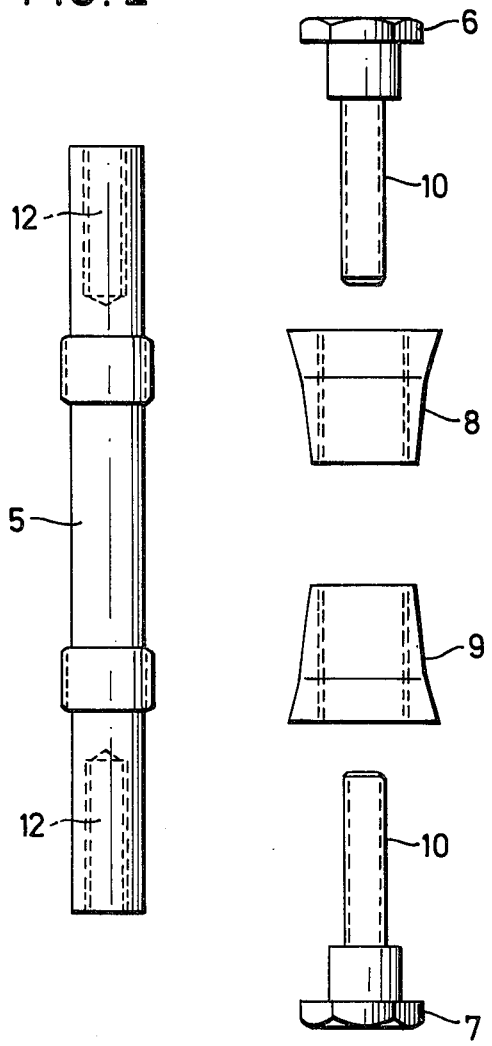
FIG. 2 is a view of the individual supporting bolt elements, shown disassembled.

FIG. 2 shows a modified embodiment of the invention wherein the individual supporting bolt elements can be seen in a disassembled (exploded) form. This embodiment is characterized by holding elements made in the form of bushings 8',9' shaped as truncated cones, whose thicker ends are also enlarged in a concave fashion, in distinction from the embodiment of FIG. 1 in which the bushings 8,9 are not concave.

I claim:

1. A supporting bolt assembly for connecting prefabricated steps together into a stairway, said supporting bolt assembly readily permitting the steps in said stairway to be adjusted, partially disassembled and completely disassembled with respect to each other, said supporting bolt assembly comprising a one-piece, long-shanked middle bolt formed with an axial threaded bore in each of its end portions, each said step being formed with a plurality of through bores of a size and configuration to snuggly receive an end portion of said middle bolt, said supporting bolt assembly further comprising a pair of end pieces each comprising a head portion and a threaded shank, said end piece head portion having a size and configuration large enough to prevent it from passing through said step through bore, said end piece threaded shank mating with said axial threaded bore in said middle bolt end portion, said middle bolt being formed with a pair of externally threaded sections each located in predetermined spaced relation to a respective end portion of said middle bolt, said supporting bolt assembly further comprising a pair of retainers having threaded bores to mate with said middle bolt externally threaded sections respectively; whereby a stairway can be readily constructed, adjusted, and partially or totally disassembled using a plurality of said prefabricated steps and a plurality of said supporting bolt assemblies by mounting each step at it's through bore at an end portion of a middle bolt of a supporting bolt assembly between a head portion of an end piece and the adjacent retainer on said middle bolt of said supporting bolt assembly.

2. A supporting bolt assembly according to claim 1, wherein each of said end pieces is a respective end bolt having an elongated threaded section.

3. A supporting bolt assembly according to either of claim 1 or claim 2, wherein said middle bolt is provided with a through internal bore.

4. A supporting bolt assembly according to claim 3, wherein said middle bolt is provided with a through internal thread.

5. A supporting bolt assembly according to either claim 1 or claim 2, wherein at least one of said end pieces includes an internal thread for fastening a bannister.

6. A supporting bolt assembly according to claim 1 or claim 2, at least one support plate serving as a support for at least one of said steps against a vertical wall, said support being tensionably mounted between one of said end pieces and a corresponding one of said retainers.

7. A supporting bolt assembly according to claim 6, wherein each of said retainers is in the form of a respective bushing with a through internal thread.

8. A supporting bolt assembly according to claim 7, wherein at least one of said bushings is in the form of a truncated cone whose larger end is opposite said head of the corresponding said end piece.

9. A supporting bolt assembly according to claim 8, wherein the profile of said truncated cone is curved in a concave manner at least toward its larger end.

* * * * *